United States Patent [19]

Kusko

[11] 4,339,706

[45] Jul. 13, 1982

[54] CURRENT CONTROLLING

[75] Inventor: Alexander Kusko, Newton, Mass.

[73] Assignee: Jodice Controls Corporation, Waltham, Mass.

[21] Appl. No.: 933,646

[22] Filed: Aug. 14, 1978

Related U.S. Application Data

[63] Continuation of Ser. No. 581,876, May 29, 1975, abandoned.

[51] Int. Cl.[3] ..... G05F 1/38

[52] U.S. Cl. ..... 323/248; 323/331; 323/345

[58] Field of Search ..... 323/6, 7, 44 R, 48, 323/60, 61, 237, 248, 250, 331, 345; 336/165

[56] References Cited

U.S. PATENT DOCUMENTS

| | | | |
|---|---|---|---|
| 2,434,493 | 1/1948 | Gburski | 323/60 X |
| 2,436,925 | 3/1948 | Haug et al. | 323/60 |
| 2,512,976 | 6/1950 | Smeltzly | 323/6 |
| 2,615,067 | 10/1952 | Bridges | 336/165 X |
| 2,825,865 | 3/1958 | Hauck et al. | 323/7 X |
| 3,041,523 | 6/1962 | Kuba | 323/61 X |
| 3,219,957 | 11/1965 | Feinberg | 336/165 |
| 3,398,292 | 8/1968 | Kuba | 323/60 X |
| 3,466,527 | 9/1969 | Chun | 323/62 X |
| 3,546,571 | 12/1970 | Fletcher et al. | 323/60 X |
| 3,659,191 | 4/1972 | Spreadbury | 323/60 X |
| 3,686,561 | 8/1972 | Spreadbury | 323/60 X |

OTHER PUBLICATIONS

Kusko et al., "Transfilter", IEEE Transactions on Magnetics, vol. MA6-12, No. 4, Jul. 1976, pp. 389-392.

*Primary Examiner*—A. D. Pellinen
*Attorney, Agent, or Firm*—Charles Hieken

[57] ABSTRACT

A generally figure-of-eight transformer core carries first, second and third toroidal windings spaced along its central leg and is formed with magnetic shunts across the gaps between central and outside legs in the planes between windings. A capacitor is connected across the second winding of value so that it coacts with the effective leakage reactances provided by the magnetic shunts so that the output load current provided by the third winding is directly proportional to the input voltage applied across the first winding independently of the load impedance and with low distortion, even in the presence of high harmonic content in the input voltage and a nonlinear load impedance.

11 Claims, 19 Drawing Figures

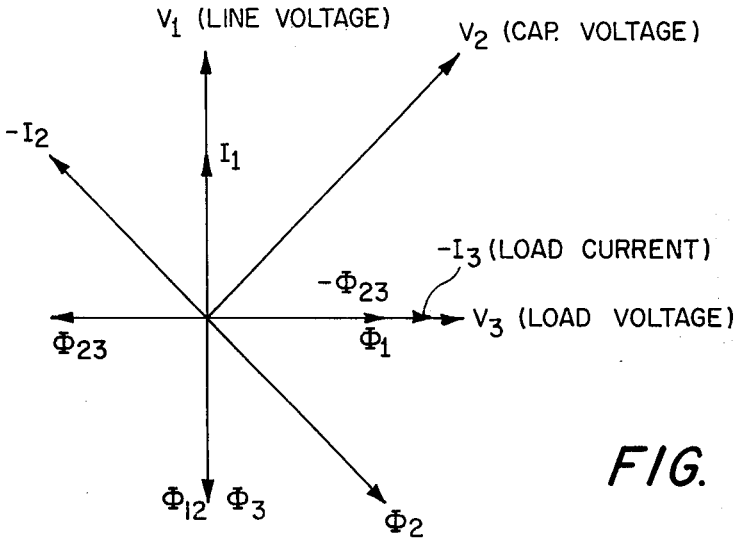
FIG. 3
FIG. 4A
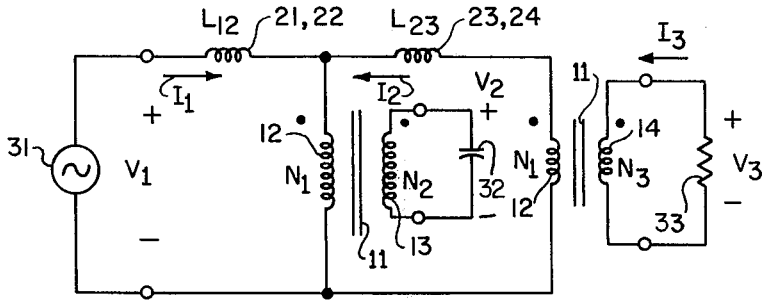
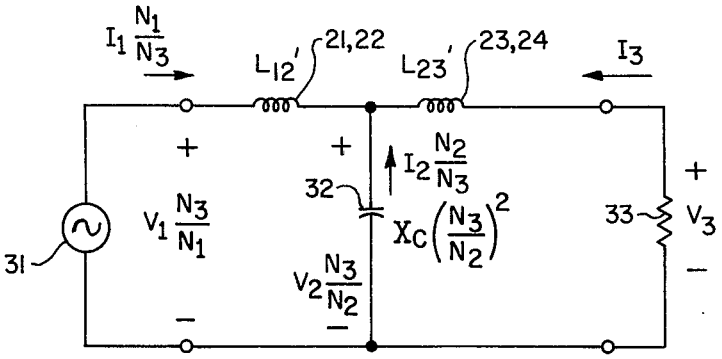
FIG. 4B

CORE EI 5731 M-6 LAMINATION
STACK HEIGHT = 4"

CURRENT CONTROLLING

This is a continuation of application Ser. No. 581,876, filed May 29, 1975 now abandoned.

BACKGROUND OF THE INVENTION

The present invention relates in general to current controlling and more particularly concerns novel apparatus and techniques for controlling output current while keeping harmonics low with a rugged reliable circuit that is self-protecting against short circuit and open circuit.

It is an important object of the invention to provide methods and means for controlling an a-c load current with an a-c voltage independently of the load.

It is another object of the invention to achieve one or more of the preceding objects while providing protection against the output terminals to which the load is connected being short circuited and open circuited.

It is a further object of the invention to achieve one or more of the preceding objects while adjusting load current by varying an input voltage.

It is a further object of the invention to achieve one or more of the preceding objects while producing a sine wave load current in the presence of a highly distorted voltage in the circuit.

It is a further object of the invention to achieve one or more of the preceding objects to produce a sine wave load current even when driving loads with highly nonlinear characteristics.

It is still another object of the invention to achieve one or more of the preceding objects with components that are relatively low in cost and highly reliable.

It is still a further object of the invention to achieve one or more of the preceding objects with high efficiency.

It is still another object of the invention to achieve one or more of the preceding objects with a system in which the desired load current rapidly follows a desired change designated by a change in control voltage.

SUMMARY OF THE INVENTION

According to the invention, there are first winding means for receiving input power, second winding means for delivering power to a load and third winding means for coupling to capacitive means. There is magnetic circuit means for magnetically intercoupling the first, second and third winding means. There is capacitive means for storing energy coupled to the second winding means. According to a preferred form of the invention the first, second and third winding means comprise toroidal windings spaced along the center leg of a figure-of-8 magnetic core that comprises means for magnetically intercoupling the winding means. Preferably, there are magnetic shunts in the gaps adjacent to the center leg.

An exemplary system according to the invention includes an SCR circuit in series with the first input winding means and a source of a-c energy for controlling the effective voltage to the first winding means and thereby controlling the current delivered to the load that is coupled to the third winding means.

Numerous other features, objects and advantages of the invention will become apparent from the following specification when read in connection with the accompanying drawing in which:

BRIEF DESCRIPTION OF THE DRAWING

FIG. 3 is a diagram illustrating the relationship among voltages, currents and flux helpful in understanding the principles of the invention for a resistance load;

FIGS. 4A and 4B are equivalent circuits of the system of FIG. 2 referred to the input and output windings, respectively;

DETAILED DESCRIPTION OF PREFERRED EMBODIMENTS

Figure 1:
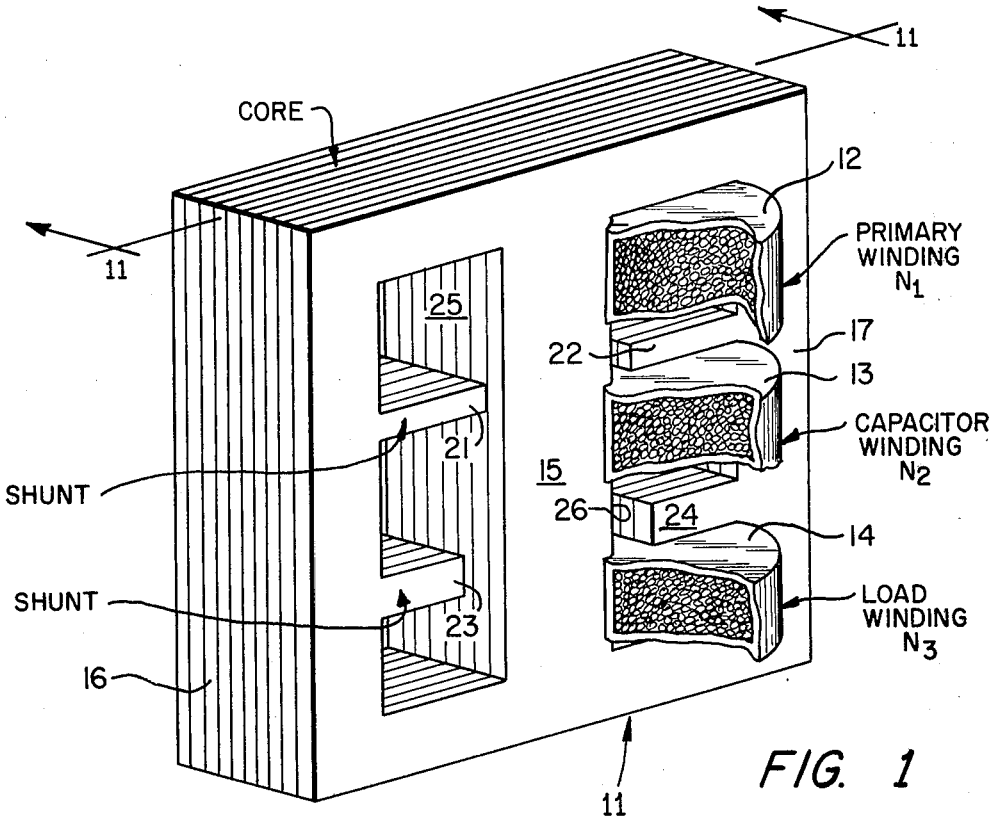
FIG. 1 is a perspective view of toroidal windings upon a core according to the invention with portions of the windings cut away to better illustrate the magnetic structure.

With reference now to the drawing and more particularly FIG. 1 thereof, there is shown a perspective view of toroidal windings according to the invention mounted upon the center leg of a generally figure-of-8 core with portions of the windings cut away to better illustrate the core structure. The same reference symbols identify corresponding elements throughout the drawing.

A transformer core of generally figure-of-8 cross section 11 carries first, second and third toroidal windings 12, 13 and 14, respectively, on its center leg 15 and magnetically intercouples these windings. End legs 16 and 17 carry a first pair of magnetic shunt legs 21 and 22 centered in the plane between windings 12 and 13, a second pair of magnetic shunt legs 23 and 24 embracing the plane between windings 13 and 14. Shunts 21 and 23 are in the gap 25 between end leg 16 and center leg 15 while shunts 22 and 24 are in the gap 26 between center leg 15 and end leg 17. Each shunt leg is separated from center leg 15 by a small air gap. It is convenient to refer to the first winding 12 as the primary or input winding having $N_1$ turns, the second winding 13 as the capacitor winding having $N_2$ turns and the third winding 14 as the load, secondary or output winding having $N_3$ turns. The magnetic structure shown in FIG. 1 is fabricated from the same oriented or non-oriented core materials and windings and with the same techniques as are used for ordinary transformers. The shunts may be of the push-in type, or be built integrally with the laminations as shown in FIG. 1.

Figure 2:
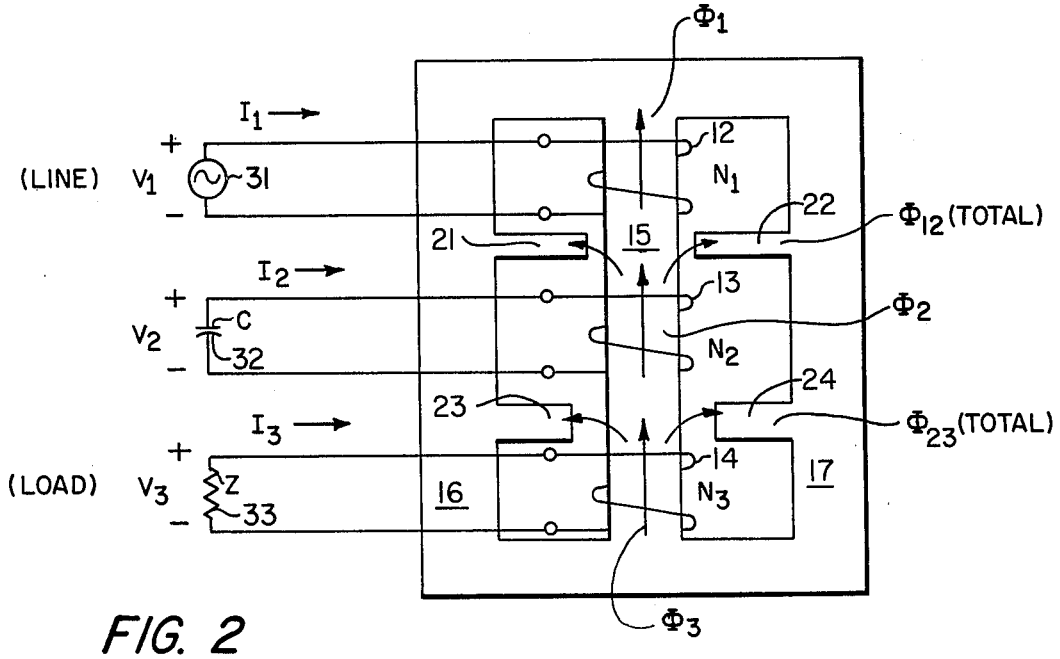
FIG. 2 is a schematic circuit diagram of a system according to the invention.

Referring to FIG. 2, there is shown a schematic circuit diagram of a system according to the invention. A voltage source 31 is connected across primary winding 12 to provide an a-c current designated $I_1$ at a potential designated $V_1$. A capacitor of capacitance C is connected across capacitor winding 13 and develops a voltage $V_2$ and current $I_2$ of the senses indicated. A load impedance of impedance Z is connected across winding 14 and develops a voltage $V_3$ and current $I_3$ of the sense indicated.

Windings 12, 13 and 14 are wound in the indicated sense. A flux $\Phi_3$ enters at the bottom of center leg 15, and a flux of $\Phi_1$ leaves at the top of leg 15. A total shunt flux of $\Phi_3$ leaves leg 15 through shunt legs 23 and 24, and a total flux of $\Phi_{12}$ leaves leg 15 through shunts 21 and 22.

This system results in the load current $I_3$ being directly proportional to the source voltage $V_1$ and independent of the load impedance 33 is the reactances referred to load winding 14 of the leakage reactances provided by shunts 21, 22, 23 and 24 and the reactance of capacitor 32 have a predetermined relationship established from the following analysis.

The equations describing the magnetic circuit in a consistent set of units (mks), and using rms phasors (complex numbers) are as follows: The winding voltages are, $$V_1 = j\omega N_1 \Phi_1$$

$$V_2 = j\omega N_2 \Phi_2$$

$$V_3 = j\omega N_3 \Phi_3$$

The winding current in terms of the permeances of the leakage flux paths ($P_{12}$ and $P_{23}$), are, $$I_1 = \frac{-\Phi_{12}}{N_1 P_{12}}$$

$$I_3 = \frac{\Phi_{23}}{N_3 P_{23}}$$

Assuming an ideal core requiring no magnetizing ampere turns, the currents are, $$0 = N_1 I_1 + N_2 I_2 + N_3 I_3$$

The terminal conditions are, $$Z_3 = \frac{-V_3}{I_3}$$

$$X_c = \frac{V_2}{jI_2}$$

The magnetic-circuit equations can be solved for the load current $I_3$ as a function of line voltage $V_1$, load impedance $Z_3$, and capacitor reactance $X_c$, to yield, $$I_3\left[1 + \left(\frac{P_{23}}{P_{12}} + \frac{Z_3}{j\omega N_3{}^2 P_{23}}\right)\left(1 - \frac{\omega N_3{}^2 P_{12}}{X_c N_3{}^2/N_2{}^2}\right)\right] = \frac{-V_1}{j\omega N_3{}^2 P_{12}}$$

The terms $\omega N_3{}^2 P_{12}$; $\omega N_3{}^2 P_{23}$; $X_c N_3{}^2/N_2{}^2$; represent the reactances referred to the $N_3$ load winding of the leakage reactances between the windings shown in FIG. 2 and the reactance of the capacitor. By making the reactances equal, $\omega N_3{}^2 P_{12} = X_c N_3{}^2/N_2{}^2$, and the load current $I_3$ is independent of the load impedance $Z_3$, or $$I_3 = \frac{-V_1}{j\omega N_3{}^2 P_{12}}$$

where the denominator is the leakage reactance between the primary and capacitor windings. The reactance can be defined as $X_O$, the characteristic reactance of the structure.

Referring to FIG. 3 there is shown the phasor diagram for the condition that impedance 33 is a load that is entirely resistive.

Referring to FIGS. 4A and 4B, there is shown equivalent circuits of FIG. 2 referred to windings 12 and 14, respectively. The inductances $L_{12}$, $L'_{12}$, $L_{23}$ and $L'_{23}$ are related to the geometry of the shunts as follows:

$$L_{12} = N_1{}^2 P_{12} \qquad L_{12}' = N_3{}^2 P_{12}$$

$$L_{23} = N_1{}^2 P_{23} \qquad L_{23}' = N_3{}^2 P_{23}$$

$$P_{12} = \mu_0 \frac{A_{12}}{\delta_{12}} \qquad P_{23} = \mu_0 \frac{A_{23}}{\delta_{23}}$$

where $A_{12}$ and $A_{23}$ are the total cross-sectional areas of the leakage flux paths and $\delta_{12}$ and $\delta_{23}$ are the total gap lengths of the leakage flux paths.

Figure 5A:
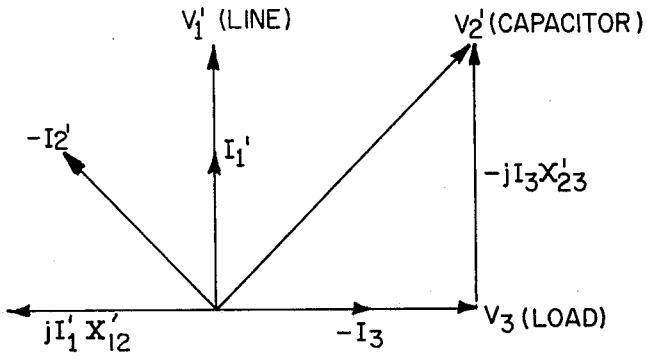
FIGS. 5A and 5B are phasor diagrams of equivalent circuits for resistive and inductive reactive loads, respectively.
Figure 5B:
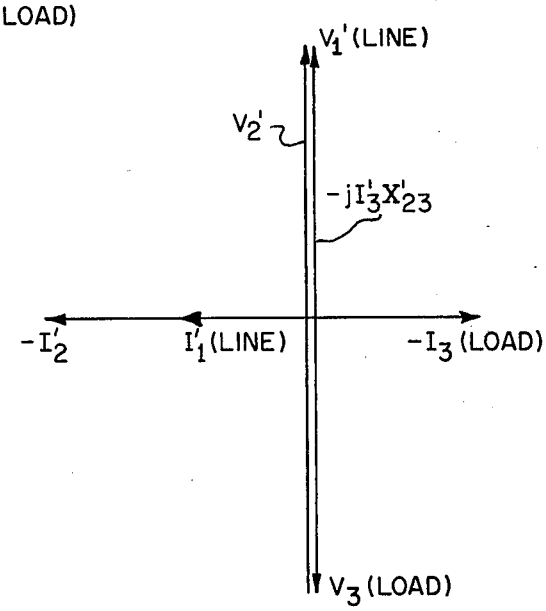

Referring to FIGS. 5A and 5B, there is shown the phasor diagrams of the equivalent circuit of FIG. 4B for resistive load and inductive reactive load conditions, respectively. Observe that the lagging power factor of the load current is translated into a leading power factor at the input to winding 12.

Figure 6:
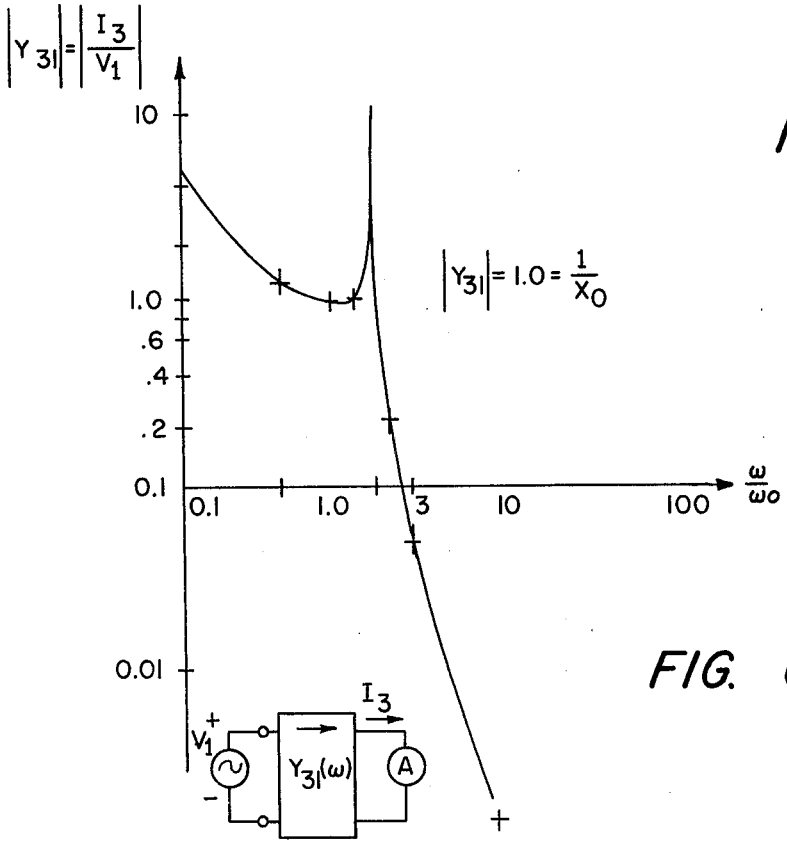
FIG. 6 is a graphical representation of the short circuit transfer admittance between the input and output windings as a function of normalized radian frequency.

The invention is also effective in attenuating the harmonics present in the primary line voltage across winding 12 from the load current delivered to load 33. This result will be better understood from the following analysis. Referring to FIG. 6, there is shown the transfer admittance $Y_{31}$ between input winding 12 and load winding 14 with the latter short circuited as a function of normalized frequency.

For the nominal design condition of $\omega_0 L_{12}' = \omega_0 L_{23}' = X_c' = X_0$, the transfer admittance is of the form, $$Y_{31} = \frac{1}{j(\omega/\omega_0)X_0[2 - (\omega/\omega_0)^2]}$$

The admittance is equal to $1/jX_0$ at $(\omega/\omega_0)=1$, and falls approximately as $(\omega/\omega_0)^3$ after the pole at $\omega/\omega_0=\sqrt{2}$. The attenuation to the harmonics of line voltage, such as produced by SCR's is severe. The third harmonic is attenuated by a factor of about 20.

Figure 7:
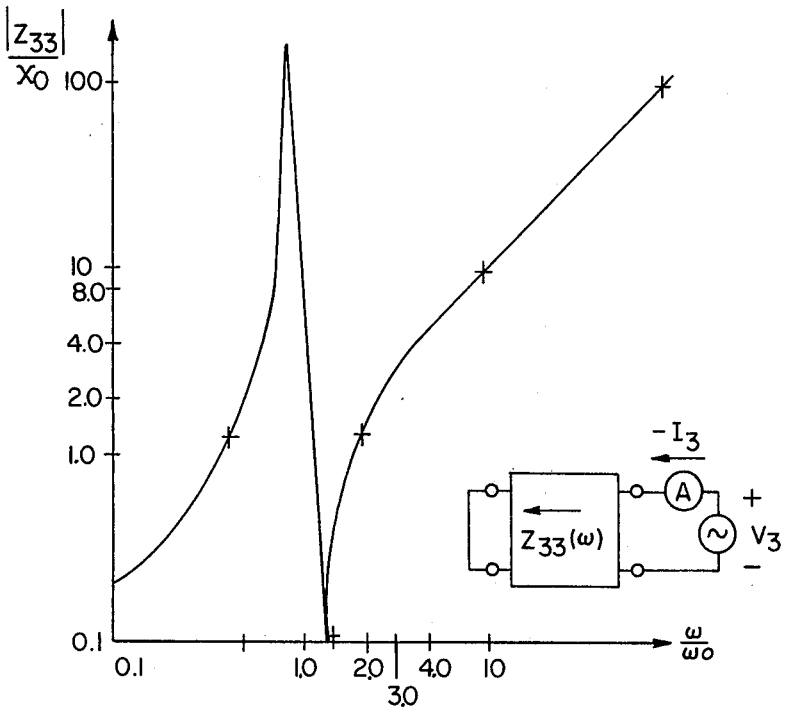
FIG. 7 is a graphical representation of the short circuit driving impedance from the output winding as a function of normalized radian frequency.

Referring to FIG. 7, there is shown a graphical representation of driving point impedance presented to the load with the primary winding 12 short circuited as a function of normalized radian frequency. For the nominal design conditions, the impedance is of the form, $$Z_{33} = \frac{j(\omega/\omega_0)X_0[2 - (\omega/\omega_0)^2]}{1 - (\omega/\omega_0)^2}$$

As $\omega/\omega_0$ increases above unity, the impedance tends to increase as the first power of $(\omega/\omega_0)$. The impedance is provided basically by the $L_{23}$ element.

Figure 8:
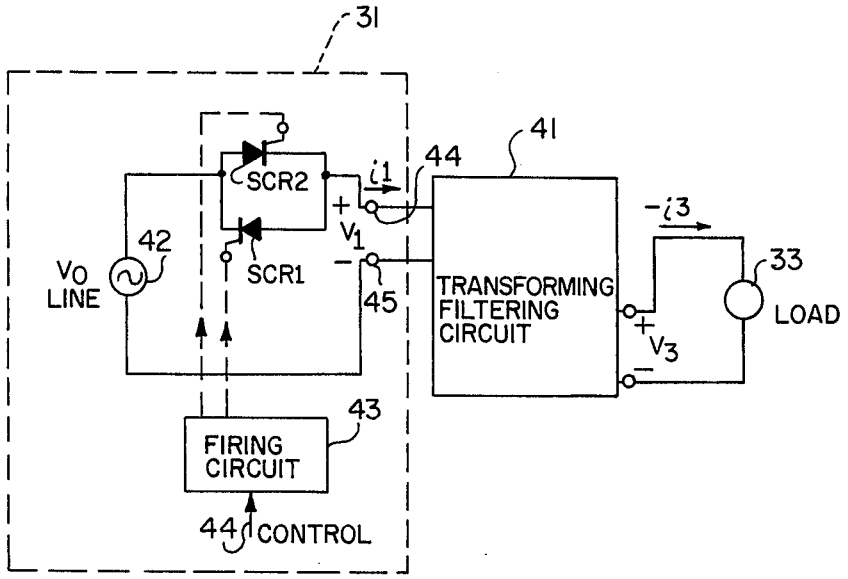
FIG. 8 is a combined block-schematic circuit diagram of an exemplary system according to the invention using SCR's for control of input voltage and load current.

Referring to FIG. 8, there is shown a combined block-schematic circuit diagram illustrating the logical arrangement of a system embodying substantially the transforming filtering circuit 41 of FIG. 2 with voltage source 31 comprising the conventional a-c power line 42 in series with SCR's SCR1 and SCR2 having their control electrodes coupled to firing circuit 43 that responds to a control signal on its input 44 to control the firing angle of SCR1 and SCR2 and thereby the effective voltage applied across terminals 44 and 45 that are across primary winding 12. Other methods of controlling the voltage applied between terminals 44 and 45 may be used within the principles of the invention, such as adjustable transformers, series impedance, magnetic amplifiers and other means known in the art.

Figure 9:
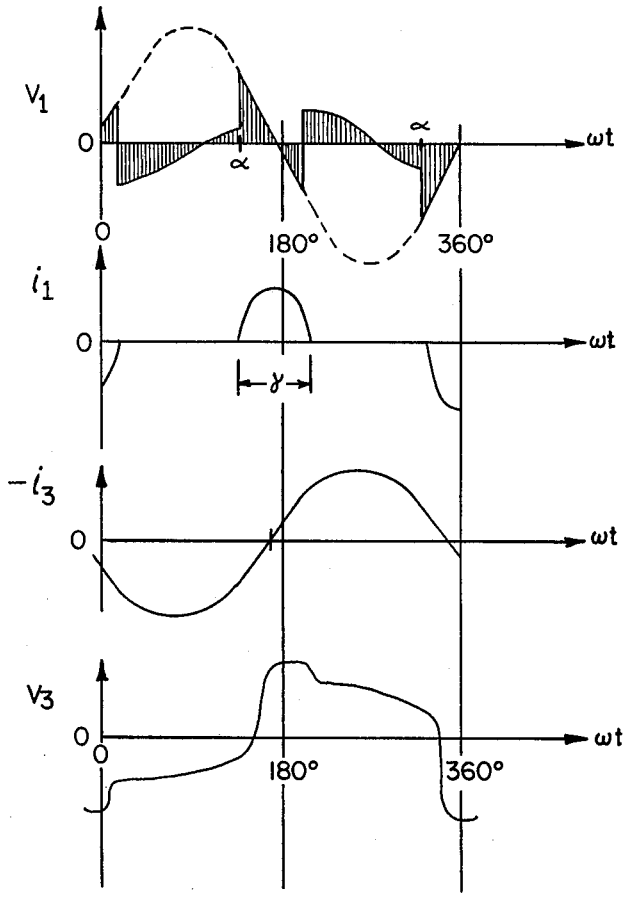
FIG. 9 is a graphical representation of the waveforms of input and load currents and voltages with a saturating inductive load and SCR control plotted to a common time scale.

Referring to FIG. 9, there is shown the waveforms of input current $I_1$, input voltage $V_1$, load current $I_3$ and load voltage $V_3$ plotted to a common time scale. In this example the load is a saturating magnetic device, specifically a CO-5 overcurrent relay.

Figure 10:
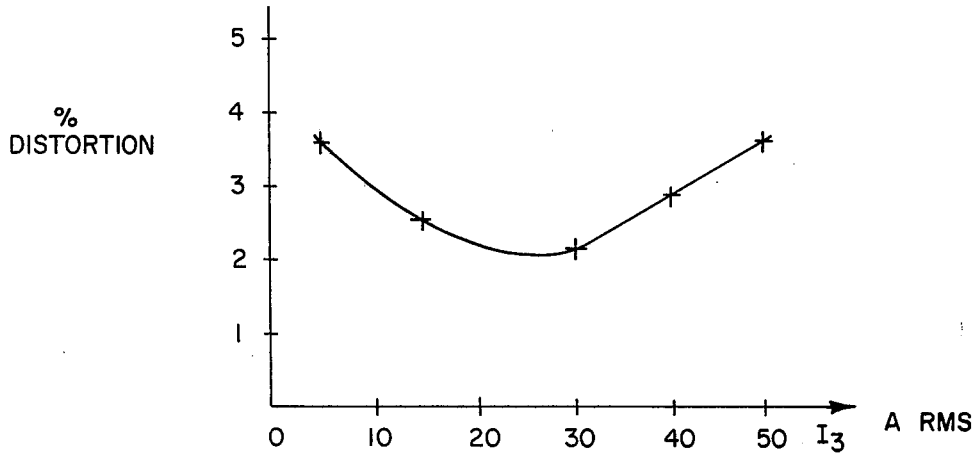
FIG. 10 shows measured percent harmonic distortion as a function of load current driving a CO5 relay on the 4A tap.

The SCR's behave as though they are supplying current to a load inductance, primarily inductance $L_{12}$ in the equivalent circuit of FIG. 4A. The current through the SCR's and primary current $I_1$ consists of pulses whose amplitude and width are determined by the load current and voltage requirements. The SCR's are fired each half cycle at angle $\alpha$ and conduct over angle $\gamma$. The filtering effect of the invention against both the distorted input and load voltages is evident in the sinusoidal load current waveform. Referring to FIG. 10, there is shown a graphical representation of the measured percent harmonic distortion of load current driving a CO-5 relay on the 4A tap as a function of load current $I_3$. The distortion of less than 4% over a current range greater than 40A results in a sinusoidal current waveform with distortion so small that it is not observable on an oscilloscope.

Figure 11:
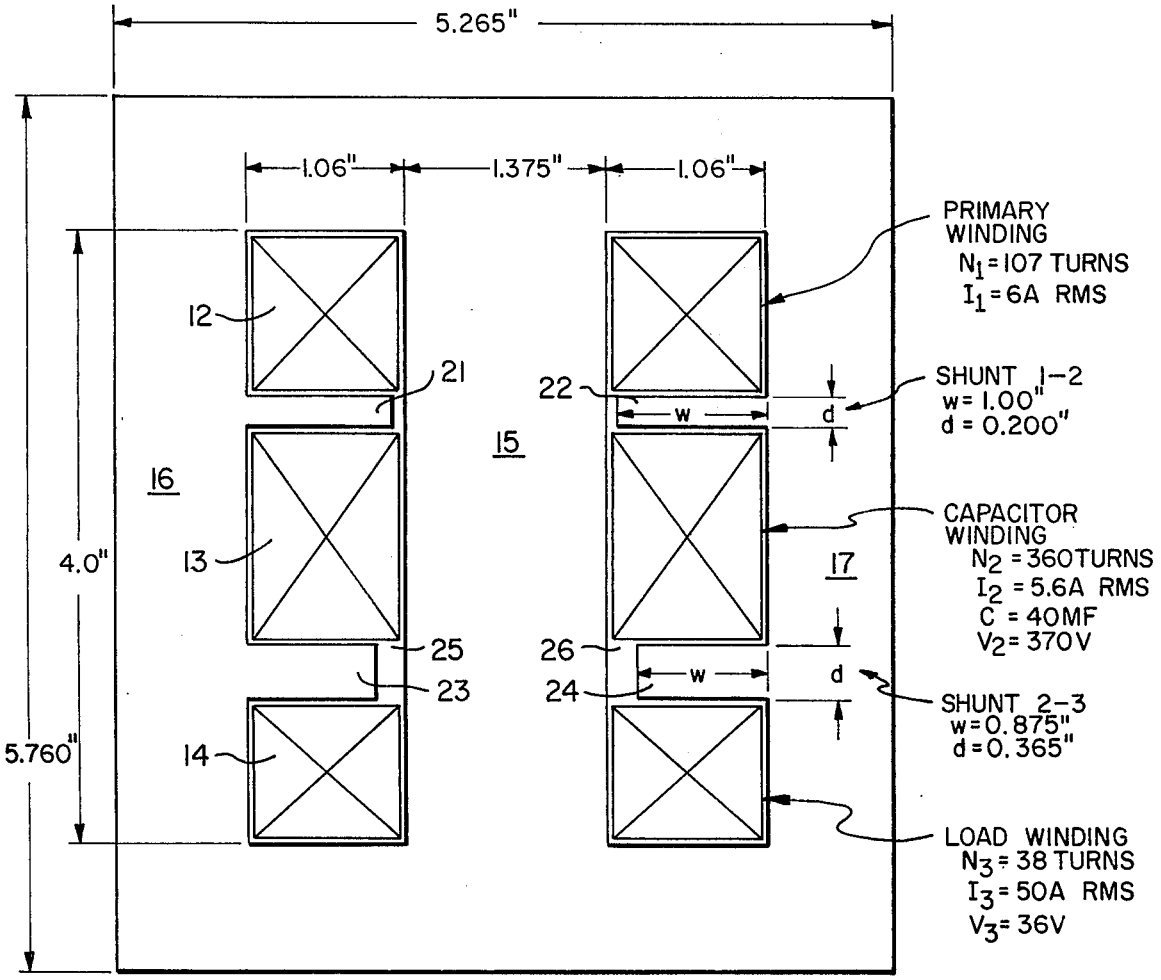
FIG. 11 is a sectional view of the structure shown in perspective view in FIG. 1 illustrating specific dimensions of an actual working embodiment of the invention.

Referring to FIG. 11, there is shown a sectional view through section 11-11 of the magnetic core structure in FIG. 1 together with details on the structure, turns, currents and capacitor size of a specific embodiment having an equivalent reactance $X_0$ translated to the load winding terminals of 0.72 ohms. This specific embodiment operated from a 115 volt, 60 Hz supply using SCR's for primary voltage control to deliver current from 0 to 50 amperes into power system relays of the type CO-5, CO-6, CO-7, CO-8 and CO-9 with a nominal load voltage across load winding 14 of 36 v. rms and a nominal load current of 50 A., or 1800 VA with the typical voltage across a relay to be tested of 15 volts peak.

Preferably, all materials used in the structure are rated class F or higher. The insulation is sufficient to pass the standard acceptability test for 1500 Vac rms 60 Hz between windings and laminations. When operated continuously, the temperature rise is 60° C. maximum in a 40° C. ambient.

There are two 1-2 shunts each 4.25 inches long in a direction perpendicular to the plane of FIG. 11 comprising 140 0.014 inch laminations. There are two 2-3 shunts of the same length as the 1-2 shunts comprising 25 0.014 inch laminations. Each shunt lamination is preferably 0.014 inch M6 grain-oriented silicon steel with the grain direction along the width dimension W. The shunts are assembled by stacking laminations to the specified height and taping Nomex strips 0.010 inch thick of the same length and width as the laminations to the top and bottom lamination. The top of the shunt is then covered with one layer of class F electrical tape. Tape is then wrapped around the edges of the shunt, building up layers until achieving a width with tape of 1.040±0.005 inches.

The following steps represent the preferred installation procedure for properly positioning the shunts. Insert the shunts squarely into the appropriate sections of the structure of FIG. 11. Short the capacitor winding with the primary and load windings open. Adjust the 1-2 shunts for a primary current of 6.5 A±0.3 A with 50 Vac applied to the primary winding. The relative position of both shunts should be approximately the same after the adjustment. Use fast setting epoxy to fix the position of the shunts.

Remove the short across the capacitor winding so that the capacitor winding is then open. Short the load winding. Adjust the 2-3 shunts for a primary current of 3.7 A±0.2 A with 50 Vac applied to the primary winding. The relative position of the shunts should be approximately the same after the adjustment. Use fast setting epoxy to fix the position of the shunts.

Varnish this assembly. After varnishing the assembly, repeat the short circuit tests described above with 50 Vac applied to the primary winding to verify that the short circuit currents are within the tolerance bands specified. Readjust the shunts if the short circuit currents are out of these tolerance bands.

Figure 12:
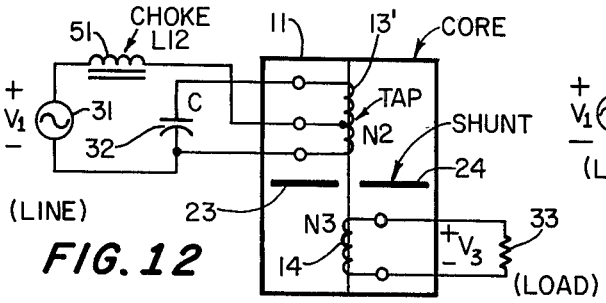
FIG. 12 is a schematic representation of another embodiment of the invention having an input choke and single shunt assembly.

Referring to FIG. 12, there is shown a schematic representation of another embodiment of the invention having an input choke 51 and single shunt assembly. A discrete choke 51 is used to obtain the inductance $L_{12}$ instead of incorporating the set of primary shunts in the magnetic structure. Capacitor winding 13' may be tapped for the input connection as shown if the capacitor voltage is higher than the line voltage.

Figure 13:
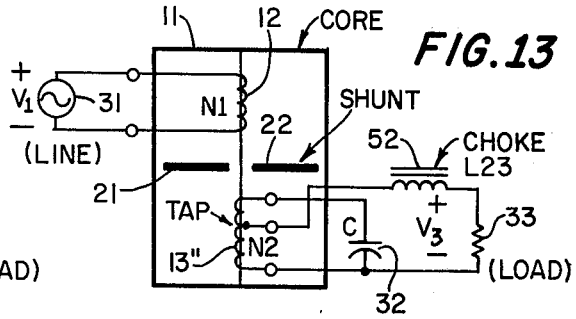
FIG. 13 is a schematic representation of another embodiment of the invention having an output choke and single shunt assembly.

Referring to FIG. 13, there is shown a schematic representation of another embodiment of the invention having an output choke and single shunt assembly. A discrete choke 52 is used to obtain the leakage inductance $L_{23}$ in a manner similar to that of the embodiment of FIG. 12.

Figure 14:
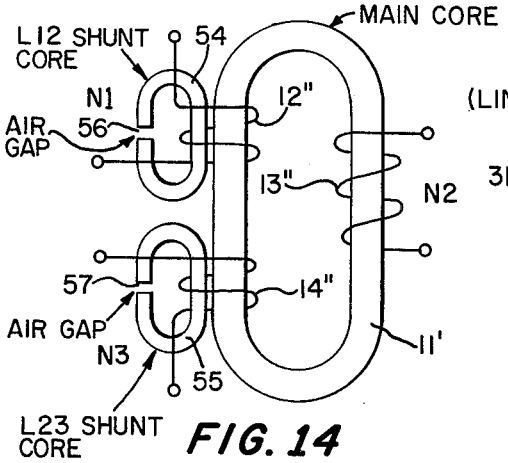
FIG. 14 is a diagrammatic representation of another embodiment of the invention having air-gapped independent cores partially within windings providing leakage flux paths.

Referring to FIG. 14, there is a diagramatic representation of another embodiment of the invention in which the leakage flux paths are provided by independent cores 54 and 55 partially within primary windings 12'' and 14'', respectively, and having air gaps 56 and 57, respectively. While the three-winding embodiment shown has leakage cores associated with input winding 12'' and output winding 14'', respectively, the leakage cores may be associated with any two of the three windings to make the fluxes $\Phi_1$, $\Phi_2$ and $\Phi_3$ independent in the manner described above in connection with the description of FIG. 2.

Figure 15:
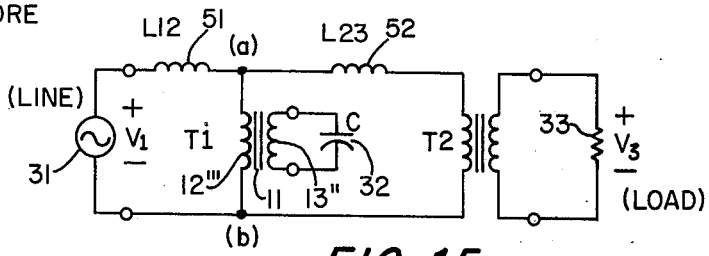
FIG. 15 is a schematic representation of another embodiment of the invention with discrete input and output chokes.

Referring to FIG. 15, there is shown a schematic representation of another embodiment of the invention using both the discrete input choke 51 and the discrete output choke 52 together with transformer $T_1$ having input winding 12'' and capacitor winding 13''. It is known in the prior art to use input choke 51 and output choke 52 with a capacitor connected directly from their junction (a) to the common line (b): however, coupling capacitor 32 through transformer $T_1$ according to the invention not only allows the most economical selection of capacitor voltage, but provides a limiter for capacitor voltage when the load is disconnected. Input choke 51, transformer $T_1$ and capacitor 32 form a ferro-resonant circuit having a finite voltage level.

Figure 16:
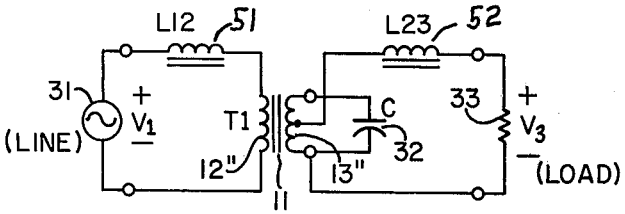
FIG. 16 is a modification of the embodiment of FIG. 15 omitting the load transformer.

Referring to FIG. 16, there is shown a schematic representation of a variation of the system of FIG. 15 with transformer $T_2$ omitted for applications where the latter is not required for limiting the open-circuit voltage. Output inductor 52 is shown connected to a tap on capacitor winding 13''. The load circuit may also be tapped onto the input winding 12'' of transformer $T_1$, but the load would not then be isolated from the source 31.

The invention may also be used in connection with 3-phase loads by carefully connecting any of the single-phase units above in triplets. Alternatively, it may be advantageous to use a 3-phase integral assembly with windings mounted upon a single three-legged core.

Figure 17:
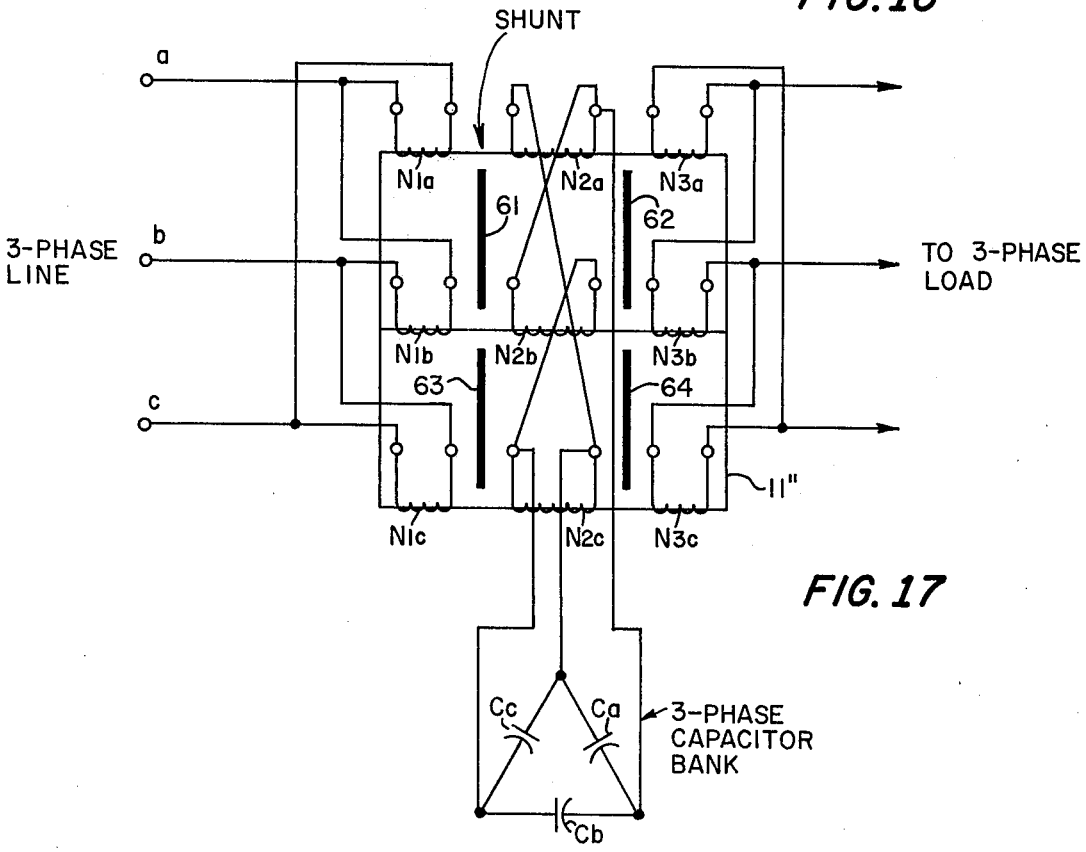
FIG. 17 is a diagramatic representation of a three-phase integral assembly according to the invention.

Referring to FIG. 17, there is shown a diagramatic representation of one form of a three-phase integral assembly. This embodiment of the invention comprises a three-legged core 11'' with legs a, b and c associated with phases a, b and c of a three-phase line and each having an input winding $N_1$, a capacitor winding $N_2$ and an output winding $N_3$ carrying a corresponding letter subscript in FIG. 17. Capacitors $C_a$, $C_b$ and $C_c$ are associated with a respective capacitor winding as shown. Four shunts 61, 62, 63 and 64 comprise the various leakage inductances as described above. The other embodiments of the invention described above may be similarly adapted for 3-phase operation, and the windings may be connected in wye or delta configurations.

As a practical matter exact tuning, meaning that $X_c = X_{12}' = X_{23}''$ resulting in the load being driven by a perfect current source having infinite impedance is unnecessary, slight detuning still presenting a very high effective impedance to the load. The input reactive power from the line is the dual of the output reactive power to the load. That is, if the load requires Q vars (lagging) then the input requires −Q vars (leading). Departure from exact tuning is lessened when using a voltage-control means such as SCR's and a feedback current controller to help maintain a predetermined load current.

The parameters C, $L_{12}'$ and $L_{23}'$ may be adjusted to shift the poles and zeros of the transfer admittance shown in FIG. 6 and of the driving impedance from the load side shown in FIG. 7 to suppress the specific harmonics or modify the waveforms in a desired manner.

The invention has a number of features. The integral magnetic structure plus capacitor accomplish all the desired current control and filtering functions. It provides a constant sinusoidal load current independent of load impedance and proportional to primary voltage. It provides filter action against harmonics of the primary voltage and against the voltage harmonics produced by a nonlinear load. It may operate with SCR's for primary voltage control over the complete load current range. It has a fast transient response to step changes in primary voltage. It is self-protecting against short circuit and open circuit conditions. It is highly efficient, mechanically rugged and relatively compact. It is relatively easy to fabricate.

It is evident that those skilled in the art may now make numerous uses and modifications of the specific embodiments described herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. Apparatus for controlling load current comprising, a capacitor, capacitor winding means for coupling to said capacitor, first inductive reactance means for receiving input power for transfer to a load, second inductive reactance means for delivering power to a load, magnetic coupling means for coupling said capacitor winding means to said first inductive reactance means and said second inductive reactance means, input terminals for connection to the a-c line, controlled switching means intercoupling said input terminals with said first inductive reactance means for delivering a voltage to said first inductive means with substantial harmonics of the a-c line frequency and controlled amplitude, and means for controlling the conduction angle of said controlled switching means to control the amount of energy delivered to said first inductive reactance means, said first and second inductive reactance means, said magnetic coupling means and said capacitor winding means being for coacting with said capacitor connected across said capacitor winding means for establishing the current delivered to a load through means including said second inductive reactance means as substantially sinusoidal with the harmonics of the a-c line frequency significantly attenuated directly proportional to the voltage applied to said apparatus through means including said first inductive reactance means independently of the load coupled to said second inductive reactance means, said first inductive reactance means comprising an input winding, said second inductive reactance means comprising a load winding, there being a leakage reactance of $\omega N_3^2 P_{12}$ between said input and capacitor winding means referred to said load winding, a leakage reactance $\omega N_3^2 P_{23}$ between said load winding and said capacitor winding means referred to said load winding and a capacitive reactance of said capacitor $X_c N_3^2/N_2^2$ referred to said load winding means with the reactances $\omega N_3^2 P_{12}$ and $X_c N_3^2/N_2^2$ being substantially equal to each other at said a-c line frequency, wherein $\omega$ is the radian frequency of the electrical power on said a-c line, $N_2$ is the number of turns of said capacitor winding means, $N_3$ is the number of turns of said load winding, $P_{12}$ is the permeance of the leakage flux path between said input winding and said capacitor winding means, $P_{23}$ is the permeance of the leakage flux path between said capacitor winding means and said load winding, and $X_c$ is the reactance of said capacitor.

2. Apparatus for controlling load current in accordance with claim 1 wherein said apparatus comprises, magnetic coupling means characterized by magnetic reluctance that is much lower than the reluctance of air for magnetically intercoupling said input winding, load winding and capacitor winding means, and magnetic shunt means for providing a shunt path for magnetic flux passing through said input and load windings as an alternative to the flux path through said capacitor winding means for coacting with said input and load windings for comprising said first and second inductive reactance means respectively.

3. Apparatus for controlling load current in accordance with claim 2 wherein said magnetic coupling means comprises a magnetic core of generally figure-of-eight cross section having a center leg carrying said input, capacitor and output windings in that order, said magnetic shunt means comprising low reluctance magnetic material in series with an air gap between said center leg and each end leg of the magnetic structure in at least the plane between said capacitor winding means and one other of said winding means.

4. Current controlling apparatus in accordance with claim 3 for multiple phase operation wherein a plurality of legs comprising said generally figure-of-eight core each carry input and load winding separated by capacitor winding means.

5. Current controlling apparatus in accordance with claim 3 wherein said magnetic shunt means is in the plane between said input winding and capacitor winding means and in the plane between said load winding and capacitor winding means.

6. Current controlling apparatus in accordance with claim 3 wherein the low reluctance magnetic material in series with an air gap is between the capacitor winding means and said load winding and said inductive reactance means comprises a discrete choke connected to said capacitor winding means.

7. Current controlling apparatus in accordance with claim 3 wherein said low reluctance magnetic material in series with an air gap is in the plane between said capacitor winding means and said input winding and said second inductive reactance means comprises a discrete choke connected to said capacitor winding means.

8. Current controlling apparatus in accordance with claim 1 wherein at least one of said first and second inductive reactance means comprises a discrete choke.

9. Current controlling apparatus in accordance with claim 8 wherein both said first and second inductive reactance means comprise discrete chokes.

10. Current controlling apparatus in accordance with claim 9 and further comprising output transformer means for coupling the load to said second inductive reactance means.

11. Apparatus for controlling load current in accordance with claim 1 wherein said controlled switching means comprises a pair of oppositely poled silicon controlled rectifiers in series with an input terminal and said first inductive reactance means and said means for controlling the conduction angle comprises a firing circuit coupled to respective gate electrodes of said silicon controlled rectifiers.

* * * * *